US009050824B2

(12) United States Patent
Marumoto et al.

(10) Patent No.: US 9,050,824 B2
(45) Date of Patent: Jun. 9, 2015

(54) PRINTING CONTROL APPARATUS, PRINTING APPARATUS, AND PRINTING METHOD

(71) Applicant: CANON KABUSHIKI KAISHA, Tokyo (JP)

(72) Inventors: Yoshitomo Marumoto, Kawasaki (JP); Hiromitsu Yamaguchi, Yokohama (JP); Hitoshi Tsuboi, Kawasaki (JP); Ryota Kato, Yokohama (JP); Takayuki Ushiyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/141,292

(22) Filed: Dec. 26, 2013

(65) Prior Publication Data

US 2014/0184679 A1 Jul. 3, 2014

(30) Foreign Application Priority Data

Dec. 28, 2012 (JP) ..... 2012-288235

(51) Int. Cl.

| | |
|---|---|
| ***B41J 29/38*** | (2006.01) |
| ***B41J 2/15*** | (2006.01) |
| ***B41J 2/155*** | (2006.01) |
| ***B41J 2/21*** | (2006.01) |

(52) U.S. Cl.

CPC ..... *B41J 2/2146* (2013.01)

(58) Field of Classification Search

CPC .. B41J 2202/20; B41J 2/2132; B41J 2/04573; B41J 2/04541; B41J 2/04543; B41J 2/04505; B41J 2/2146; B41J 2/04501

USPC ..... 347/9, 12–15, 40–42, 47, 49

See application file for complete search history.

(56) References Cited

U.S. PATENT DOCUMENTS

| | | | | |
|---|---|---|---|---|
| 8,454,110 | B2 * | 6/2013 | Ochiai et al. | 347/12 |
| 2007/0285449 | A1 * | 12/2007 | Ikemoto et al. | 347/12 |
| 2010/0321429 | A1 * | 12/2010 | Saito et al. | 347/9 |

FOREIGN PATENT DOCUMENTS

| | | | |
|---|---|---|---|
| JP | 2007-268825 | A | 10/2007 |
| JP | 2009-12390 | A | 1/2009 |

* cited by examiner

*Primary Examiner* — Jannelle M Lebron

(74) *Attorney, Agent, or Firm* — Canon U.S.A., Inc., IP Division

(57) ABSTRACT

A printing apparatus performs printing using a print head in which a plurality of ejection port arrays are arranged in such a way as to form overlap portions. Ink is ejected such that a shape of a first boundary between images printed in a first unit region by ejection ports of a first ejection port array and a second ejection port array in an overlap portion and a shape of a second boundary between images printed in a second unit region in first and second operations of scanning continuously change in an array direction as positions of the first and second boundaries change in a cross direction and the shape of the second boundary becomes different from the shape of the first boundary.

18 Claims, 13 Drawing Sheets

PRINTING CONTROL APPARATUS, PRINTING APPARATUS, AND PRINTING METHOD

BACKGROUND OF THE INVENTION

1. Field of the Invention

The present invention relates to a printing control apparatus, a printing apparatus, and a printing method.

2. Description of the Related Art

A printing apparatus that forms an image on a print medium by ejecting ink onto the print medium while scanning a print head including a plurality of ejection port arrays in which a plurality of ejection ports that eject ink of the same color are arranged in a certain array direction is known. The plurality of ejection port arrays are arranged in a direction crossing to the array direction of the ejection ports, and the print head is scanned in the direction crossing to the array direction of the ejection ports.

In these years, it is desired to improve the printing speed of such a printing apparatus, and the length of the print head is being increased to achieve this goal. In one of known methods for increasing the length of the print head, a print head (hereinafter referred to as an overlap head) in which a plurality of ejection port arrays are sequentially arranged in an array direction of a plurality of ejection ports is configured by providing portions (hereinafter referred to as overlap portions) capable of printing the same pixel rows on a print medium using certain numbers of ejection ports arranged at ends of two ejection port arrays adjacent to each other in the array direction of the plurality of ejection ports that ejects ink of the same color. According to this overlap head, the length of the print head may be increased by arranging a plurality of short ejection port arrays.

It is known when an image is printed using the overlap head, unevenness might occur in a region of the print medium in which the ejection ports arranged in the overlap portions have performed printing and image quality might deteriorate. The types of unevenness include unevenness caused by errors in the installation positions of the ejection port arrays or errors in the manufacturing process of the ejection ports and unevenness caused by differences in the ejection timing of ink from the ejection ports arranged in the overlap portions of the ejection port arrays. In Japanese Patent Laid-Open No. 2009-12390, it is disclosed that the amounts of ink ejected from the ejection ports in the overlap portions are made smaller than the amounts of ink ejected from the ejection ports in regions other than the overlap portions in order to suppress the above-described unevenness caused by differences in the ejection timing.

On the other hand, when an error has occurred in conveying of the print medium between operations of scanning of the print head, a black stripe or a white stripe might be formed at a boundary between a portion printed immediately before the conveying of the print medium and a portion printed immediately after the conveying of the print medium and the quality of the printed image might deteriorate. In Japanese Patent Laid-Open No. 2007-268825, it is disclosed that printing is performed such that the shape of the boundary between portions printed before and after the conveying becomes the shape of waves so that the stripe does not stand out.

However, because the combinations between the ejection ports included in the overlap portion between two ejection port arrays are fixed in the overlap head disclosed in Japanese Patent Laid-Open No. 2009-12390, it is assumed that positions at which unevenness caused by the overlap portions occurs remain the same on the print medium. Therefore, it is difficult to sufficiently suppress the unevenness caused by the overlap portions of the overlap head using a method for changing density, which is disclosed in Japanese Patent Laid-Open No. 2009-12390.

Therefore, the inventors have changed the positions of the ejection ports in the overlap portions in the array direction in accordance with the scanning of the print head. As a result, the positions at which the ejection ports in the overlap portions perform printing have changed on the print medium, thereby making it possible to keep the unevenness caused by the overlap portions from standing out.

Furthermore, the position of the boundary between the region printed in scanning before the conveying of the print medium and the region printed in print scanning after the conveying of the print medium has been changed in the array direction as the scanning direction has changed. As the inventors have tried to simultaneously suppress the unevenness that occurs in a region in which the ejection ports in the overlap portions perform printing and the stripe formed in a region in which printing is performed before and after the conveying of the print medium in this manner, a new problem has arisen.

This problem will be described in detail hereinafter.

FIG. 1 is a diagram illustrating a problem to be solved by the present invention.

An overlap head 1000 is configured by arranging a plurality of ejection port arrays in a certain array direction (hereinafter referred to as a Y direction). Here, among the plurality of ejection port arrays, two ejection port arrays 1100 adjacent to each other in the Y direction are arranged at different positions in the Y direction and different positions in a cross direction (hereinafter referred to as an X direction), which is crossing to the Y direction such that certain numbers of ejection ports arranged at ends of the two ejection port arrays 1100 may perform printing in the same region of a print medium 3 in the same scanning.

An image is formed on the print medium 3 by alternately performing print scanning, in which ink is ejected while scanning the overlap head in the X direction, and sub-scanning, in which the print medium 3 is relatively conveyed in the Y direction, which is a conveying direction.

Here, as illustrated in FIG. 1, a shape 1200 of waves is formed by performing printing such that the position of the boundary between two regions in which the two ejection port arrays 1100 perform printing is changed in accordance with the scanning of the above-described overlap head 1000. In addition, printing is performed such that the boundary between regions in which printing is performed in two consecutive operations of scanning before and after the conveying has a shape 1210 of waves. In this case, the shape 1200 of waves caused by the printing performed by the overlap portions and the shape 1210 of waves caused by the printing performed in two operations of scanning might be the same, thereby accentuating each other as unevenness. Such unevenness stands out especially when the shape 1200 of waves and the shape 1210 of waves have been superimposed in the same region of the print medium 3.

SUMMARY OF THE INVENTION

The present invention provides a printing control apparatus and a printing apparatus capable of printing an image in which unevenness that has occurred in the printed image does not stand out.

The present invention provides a printing control apparatus that performs control for printing an image using a print head that includes a plurality of ejection port arrays including at least a first ejection port array in which a plurality of ejection ports which eject ink of the same color are arranged in a certain array direction and a second ejection port array which is adjacent to the first ejection port array in the array direction and in which a plurality of ejection ports which eject ink of the same color are arranged in the array direction and in which the plurality of ejection port arrays are arranged in the array direction such that one ejection port array and another ejection port array adjacent to each other in the array direction are arranged at different positions in the array direction and different positions in a cross direction, which is crossing to the array direction, so that N ejection ports, N being larger than zero, located at an end of the one ejection port array on a side of the other ejection port array in the array direction and N ejection ports located at an end of the other ejection port array on a side of the one ejection port array in the array direction form an overlap portion capable of performing printing in the same region of a print medium. The printing control apparatus includes a scanning unit configured to scan the print head and the print medium in the cross direction relative to a unit region of the print medium, a conveying unit configured to convey, between operations of the scanning performed by the scanning unit, the print medium in a conveying direction, which is crossing to the cross direction, by a distance corresponding to a length smaller than a length of a range of the print head in which the ejection ports are arranged, and an ejection control unit configured to perform control such that ink is ejected onto the unit region at a certain printing ratio in each of a plurality of operations of the scanning. The conveying unit conveys the print medium such that the overlap portion between the first and second ejection port arrays corresponds to a first unit region in a first operation of the scanning among the plurality of operations of the scanning performed by the scanning unit, such that N ejection ports in a first non-overlap portion other than the overlap portions between the plurality of ejection port arrays correspond to a second unit region in a second operation of the scanning different from the first operation of the scanning among the plurality of operations of the scanning performed by the scanning unit, and such that N ejection ports in a second non-overlap portion other than the overlap portions between the plurality of ejection port arrays correspond to the second unit region in a third operation of the scanning different from the first and second operations of the scanning among the plurality of operations of the scanning performed by the scanning unit. In order to print, in the cross direction, a plurality of pixel columns including a plurality of pixels arranged in the array direction in the first and second unit regions, the ejection control unit performs control such that (i) when the ejection ports of the first and second ejection port arrays in the overlap portion perform printing in the first unit region in the first operation of the scanning, M of the N ejection ports of the first ejection port array in the overlap portion, M being equal to or larger than zero but smaller than or equal to N, closest to the second ejection port array in the array direction do not eject ink, N−M ejection ports of the first ejection port array in the overlap portion farthest from the second ejection port array in the array direction eject ink at a first printing ratio, N−M of the N ejection ports of the second ejection port array in the overlap portion closest to the first ejection port array in the array direction do not eject ink, and M ejection ports of the second ejection port array in the overlap portion farthest from the first ejection port array in the array direction eject ink at the first printing ratio, (ii) when the ejection ports in the first non-overlap portion perform printing in the second unit region in the second operation of the scanning, K of the N ejection ports in the first non-overlap portion, K being equal to or larger than zero but smaller than or equal to N, closest to the second non-overlap portion in the array direction do not eject ink and N−K ejection ports in the first non-overlap portion farthest from the second non-overlap portion in the array direction eject ink at a second printing ratio, and (iii) when the ejection ports in the second non-overlap portion perform printing in the second unit region in the third operation of the scanning, N−K of the N ejection ports in the second non-overlap portion closest to the first non-overlap portion in the array direction do not eject ink and K ejection ports in the second non-overlap portion farthest from the first non-overlap portion in the array direction eject ink at the second printing ratio. M and K continuously increase or decrease as a position of the pixel column in the first and second unit regions, respectively, changes in the cross direction. When the position of the pixel column in the first and second unit regions is a certain position in the cross direction, M and K are different values.

Further features of the present invention will become apparent from the following description of exemplary embodiments with reference to the attached drawings.

DESCRIPTION OF THE EMBODIMENTS

First Embodiment

A first embodiment of the present embodiment will be described in detail hereinafter.

Figure 2:
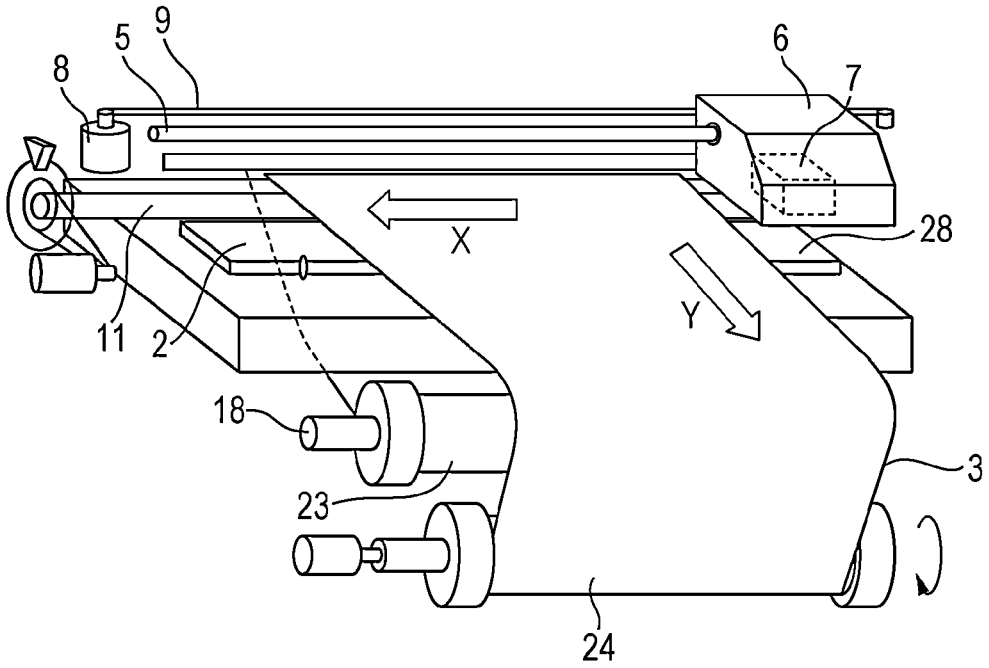
FIG. 2 is a perspective view of a printing apparatus according to embodiments.
Figure 3:
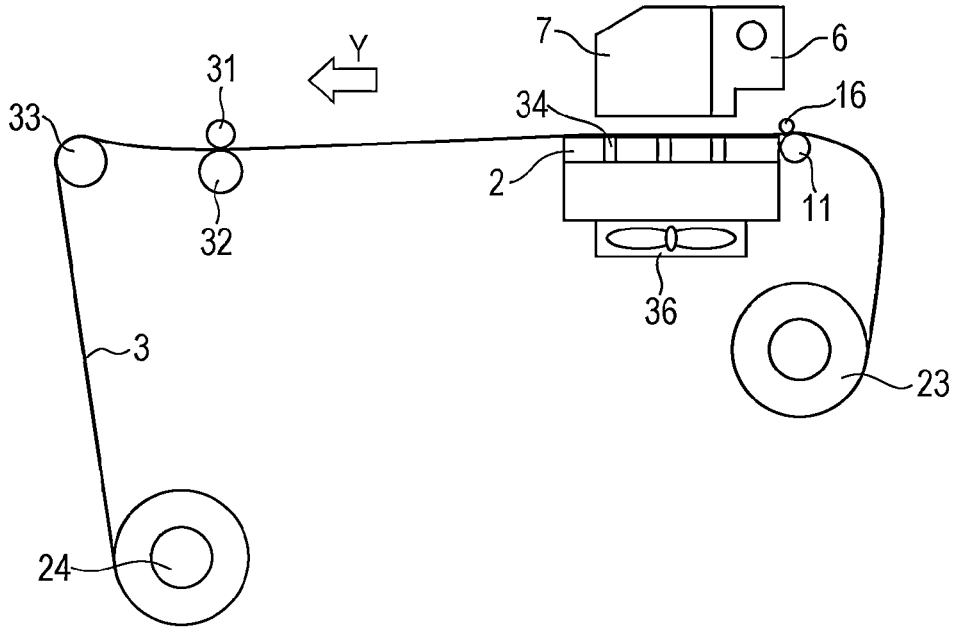
FIG. 3 is a side view of the printing apparatus according to the embodiments.

FIG. 2 is a perspective view illustrating part of the internal configuration of a printing apparatus according to the first embodiment of the present invention. FIG. 3 is a side view illustrating part of the internal configuration of the printing apparatus according to the first embodiment of the present invention.

A platen 2 is provided inside the printing apparatus, and a multiple of suction holes 34 are formed in the platen 2 in order to suck a print medium 3 onto the platen 2 so that the print medium 3 does not float. These suction holes 34 are connected to ducts, and a suction fan 36 is provided under the ducts. By operating the suction fan 36, the platen 2 sucks the print medium 3.

A carriage 6 is supported by a main rail 5 extending in a paper width direction and configured in such a way as to be able to reciprocally move in an X direction. The carriage 6 includes an overlap head 7, which will be described later, adopting an inkjet method. Alternatively, the overlap head 7 may adopt one of various printing methods such as a thermal jet method using a heating element and a piezoelectric method using a piezoelectric element. A carriage motor 8 is a driving source for moving the carriage 6 in the X direction, and the rotational driving force thereof is transmitted to the carriage 6 through a belt 9.

The print medium 3 is rolled out from a roll-like medium 23 and fed. The print medium 3 is conveyed over the platen 2 in a Y direction, which is crossing to the X direction. A leading end of the print medium 3 is pinched between a pinch roller 16 and a conveying roller 11, and the print medium 3 is conveyed by driving the conveying roller 11. In addition, the print medium 3 is pinched between a roller 31 and a discharge roller 32 downstream of the platen 2 in the Y direction, and rolled on a take-up roller 24 through a turn roller 33.

Figure 4:
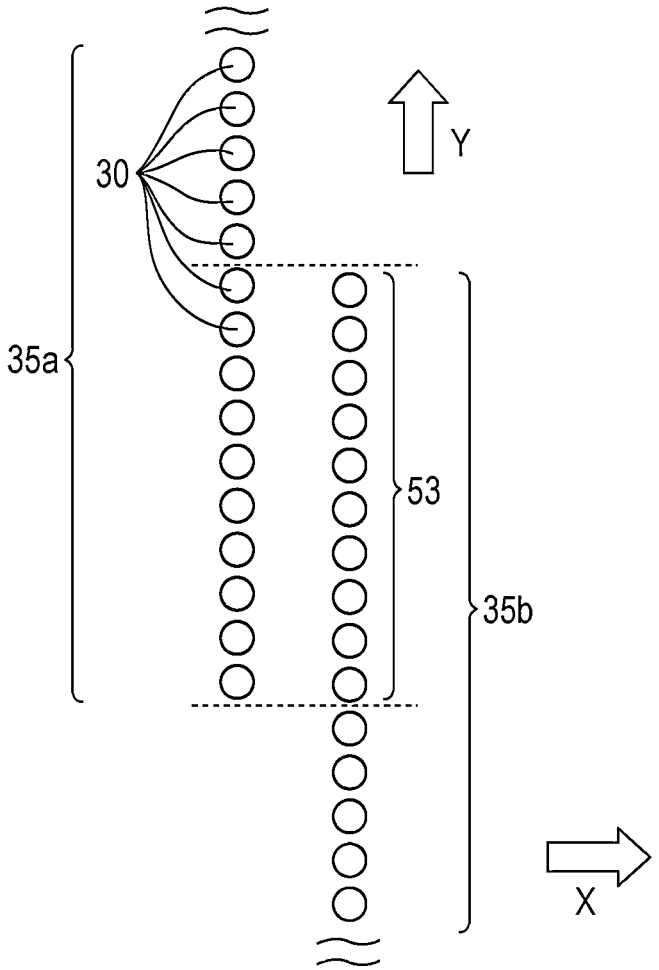
FIG. 4 is a schematic diagram illustrating an overlap head according to the embodiments.

FIG. 4 illustrates an overlap portion 53 and an area around the overlap portion 53 in the overlap head 7 used in this embodiment.

The overlap head 7 according to this embodiment includes a plurality of ejection port arrays, each of which includes 1,280 ejection ports 30 that eject ink of the same color at a density of 1,200 dpi. As illustrated in FIG. 4, among the plurality of ejection port arrays, a first ejection port array 35*a* and a second ejection port array 35*b* adjacent to each other in the X direction are arranged at different positions in the Y direction such that the positions of ten ejection ports of the first ejection port array 35*a* closest to the second ejection port array 35*b* (hereinafter referred to as downstream or downstream in a conveying direction) and the positions of ten ejection ports of the second ejection port array 35*b* closest to the first ejection port array 35*a* (hereinafter referred to as upstream or upstream in the conveying direction) correspond to each other in the Y direction. These ten pairs of ejection ports form the overlap portion 53. Therefore, the ten ejection ports of the first ejection port array 35*a* in the overlap portion 53 and the ten ejection ports of the second ejection port array 35*b* in the overlap portion 53 may form the same ten pixel rows on the print medium 3 in the X direction in the same scanning.

In the printing apparatus having the above-described configuration illustrated in FIGS. 2 and 3, the print medium 3 is conveyed from a conveying unit, which is not illustrated, in the Y direction. The overlap head 7 receives a print signal from a printing control unit, which is not illustrated, and forms dots on the print medium 3 by ejecting ink onto a printing region of the print medium 3 while scanning in the X direction (cross direction) along with the carriage 6.

After such print scanning, the print medium 3 is conveyed in the Y direction.

Figure 5:
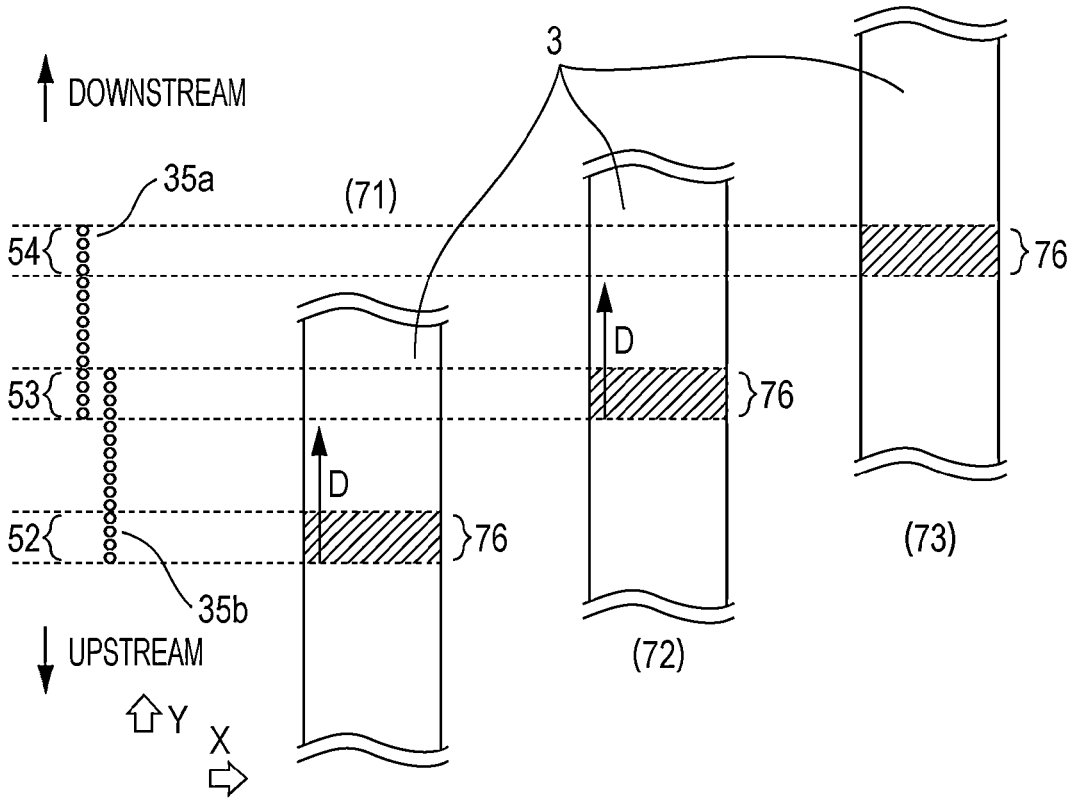
FIG. 5 is a diagram illustrating print scanning of the overlap head and conveying of a print medium according to the embodiments.

FIG. 5 is a diagram illustrating printing realized by three consecutive operations of print scanning performed in a unit region according to this embodiment.

In an N-th operation of print scanning, the print medium 3 is located at a position (71) relative to the overlap head 7. Printing is performed by ejecting ink onto the print medium 3 while scanning the overlap head 7 at the position (71) in the X direction. The printing is performed in a region 76 by a certain number of ejection ports of the second ejection port array 35*b* in an upstream end portion 52 in the Y direction.

Next, the print medium 3 is conveyed from upstream to downstream in the Y direction to a position (72) relative to the overlap head 7. Here, the print medium 3 is conveyed by a distance D, which is shorter than the length of a range over which the ejection ports are provided, so that the region 76, in which the printing has been performed by the ejection ports of the second ejection port array 35*b* in the upstream end portion 52 in the Y direction in the N-th operation of print scanning, comes to a position at which a certain number of ejection ports arranged in the overlap portion 53 perform printing in an (N+1)th operation of print scanning.

When the print medium 3 has been conveyed to the position (72), the (N+1)th operation of print scanning is performed. As described above, in the (N+1)th operation of print scanning, the plurality of ejection ports in the overlap portion 53 eject ink onto the region 76, in which the ejection ports of the second ejection port array 35*b* in the upstream end portion 52 have performed printing in the N-th operation of print scanning.

Thereafter, the print medium 3 is again conveyed by the distance D, by which the print medium 3 has been moved between the N-th operation of print scanning and the (N+1)th operation of print scanning, so that the print medium 3 comes to a position (73).

When the print medium 3 has been conveyed to the position (73), an (N+2)th operation of print scanning is performed. Here, a certain number of ejection ports of the first ejection port array 35*a* arranged in a downstream end portion 54 in the Y direction perform printing in the region 76, in which the ejection ports in the downstream end portion 52 in the Y direction have performed printing in the N-th operation of print scanning.

By alternately performing the print scanning and the conveying operation as described above, a complete image is formed in the unit region 76 of the print medium 3 through a plurality of operations of scanning.

Although a mode in which printing is performed by conveying the print medium 3 in the Y direction relative to the overlap head 7 has been described above, printing in the unit region 76 may be performed by moving the overlap head 7 in a direction opposite to the Y direction a plurality of times relative to the stationary print medium 3.

Figure 6:
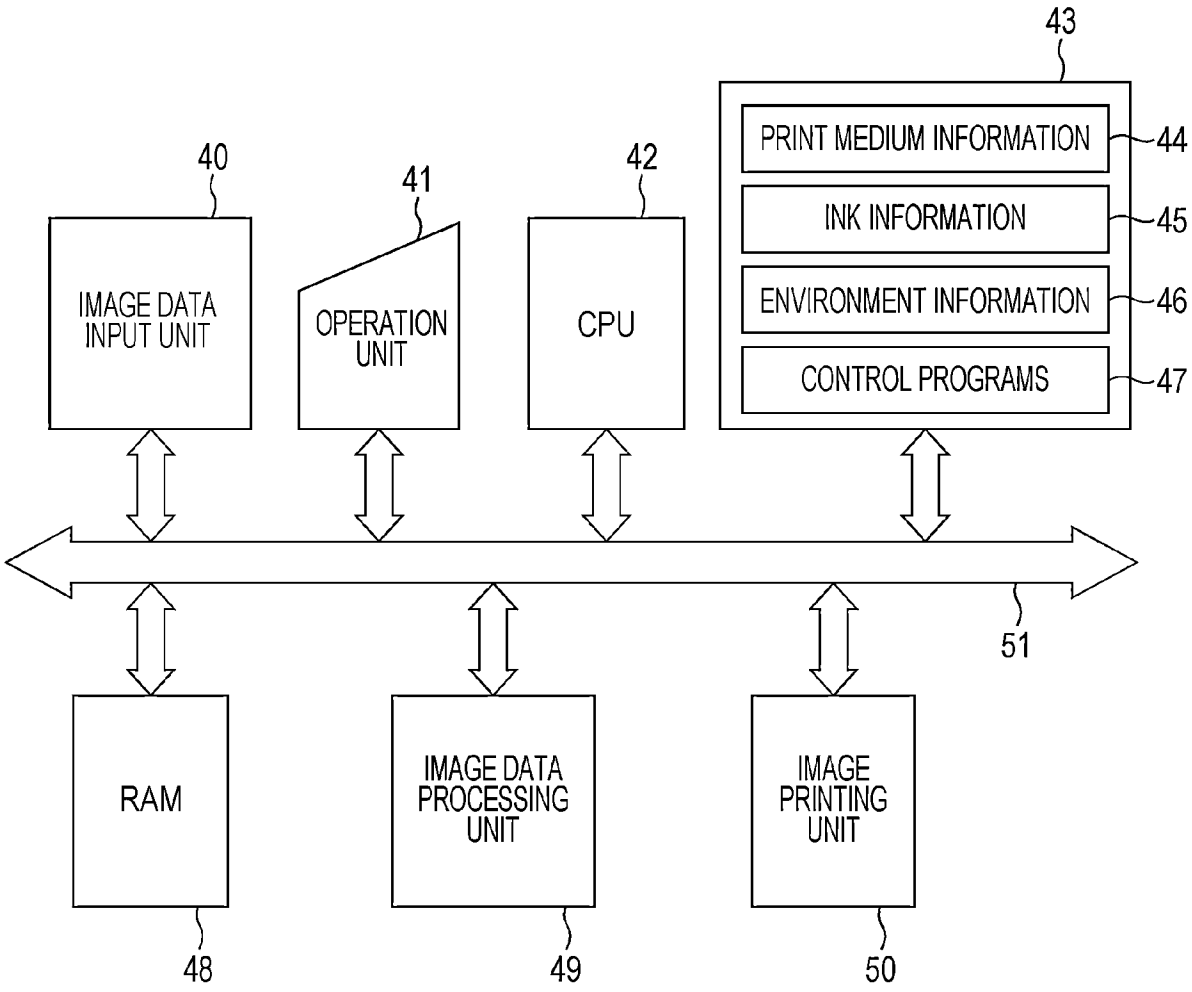
FIG. 6 is a block diagram illustrating the configuration of a printing control system according to the embodiments.

FIG. 6 is a block diagram illustrating the schematic configuration of a printing control system according to this embodiment.

An image data input unit 40 is used for inputting data regarding an image from the outside. The data regarding an image input from the outside includes, for example, data regarding an image from an image input device such as a scanner or a digital camera and data regarding an image saved in a hard disk of a personal computer (PC) or the like. An operation unit 41 includes various keys, and various parameters may be set and printing may be begun by operating these keys.

A central processing unit (CPU) 42 performs processing control such as calculation, selection, and determination for the entirety of a printing apparatus in accordance with various programs stored in a storage medium 43. The storage medium 43 stores print medium information 44 regarding the type of print medium used and the like, ink information 45 regarding the type of ink used, and environment information regarding the temperature and the humidity during printing and the like. Furthermore, various control programs 47 relating to printing are also stored in the storage medium 43. Conveying control and ink ejection control for the print medium 3 and the overlap head 7 in this embodiment are all performed in accordance with the control programs 47. As the storage medium 43 that stores various programs, for example, a read-only memory (ROM), a floppy disk, (FD), a compact disk read-only memory (CD-ROM), a hard disk (HD), a memory card, a magneto-optical disk, or the like may be used.

A random-access memory (RAM) 48 is used as a working area for various programs stored in the storage medium 43, a temporary saving area while an error is being processed, and a working area while an image is being processed. In addition, after various tables stored in the storage medium 43 are copied, the content of the tables stored in the RAM 48 may be changed, and an image may be processed while referring to the tables whose content has been changed.

An image data processing unit 49 creates an ejection pattern of ink by quantizing input multi-valued data regarding an image, which is a ternary data or more, into binary data regarding an image for each pixel in accordance with a process for processing data regarding an image, which will be described later.

In addition, the CPU 42 distributes print data in order for an image printing unit 50 to print the ejection pattern created by the image data processing unit 49.

The image printing unit 50 forms a dot image on the print medium 3 by ejecting ink from the ejection ports 30 on the basis of the ejection pattern created by the image data processing unit 49. A bus line 51 transmits address signals, data, control signals, and the like in the printing apparatus.

Figure 7:
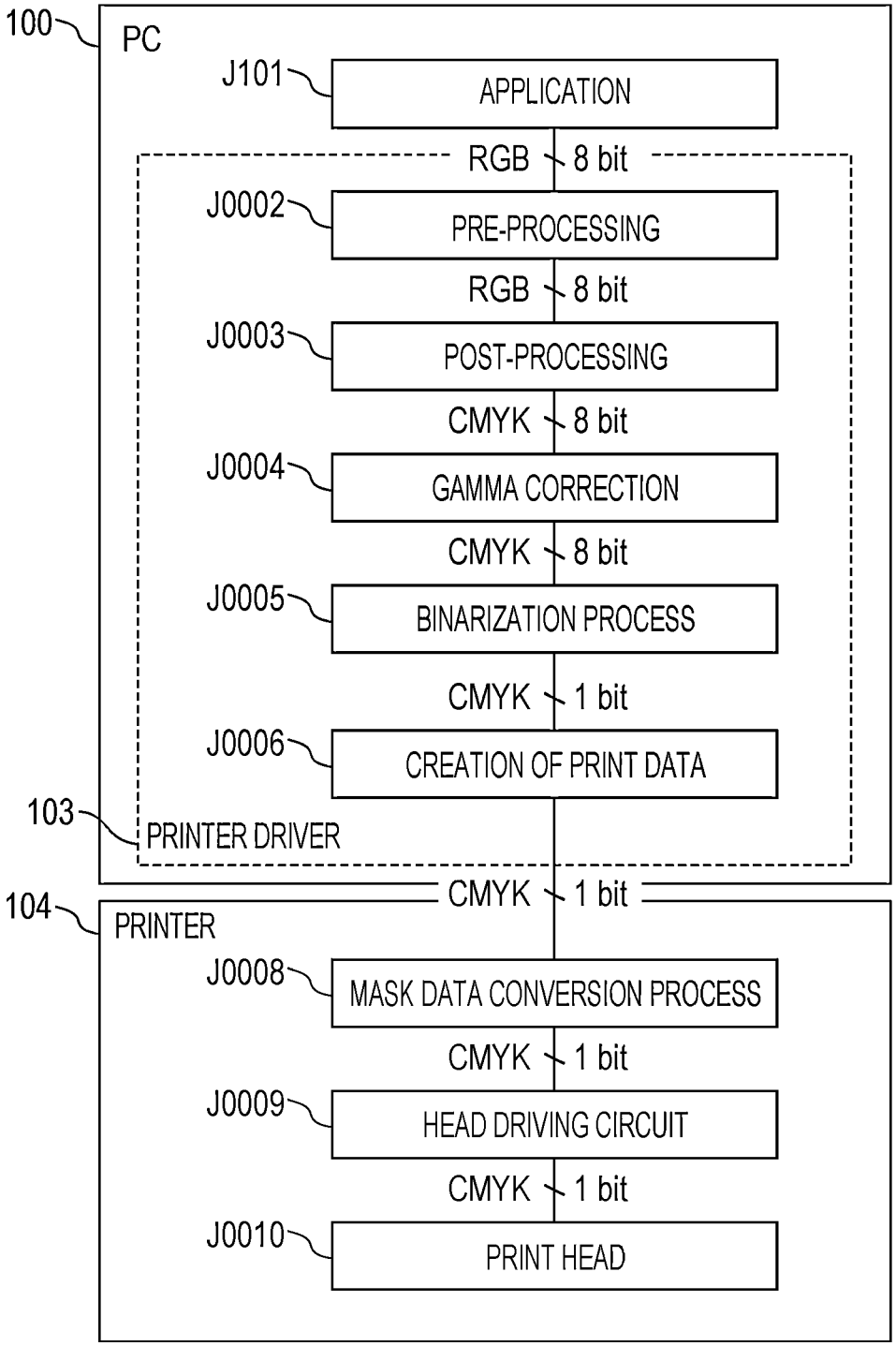
FIG. 7 is a block diagram illustrating a process for processing data according to the embodiments.

FIG. 7 is a block diagram illustrating the process for processing data performed by the image data processing unit 49. An application J101 of a PC 100 is used for creating data regarding an image to be printed by a printer 104. The data regarding an image created by the application J101 is transmitted to a printer driver 103 before printing.

The printer driver 103 executes pre-processing J0002, post-processing J0003, gamma correction J0004, a binarization process J0005, and creation of print data J0006 for the created data regarding an image.

In the pre-processing J0002, color gamut conversion in which the color gamut of a display of the PC 100 is converted into the color gamut of the printer 104 is performed. Data R, G, and B regarding an image that represents R, G, and B in 8 bits is converted into 8-bit data R, G, and B in the color gamut of the printer 104 using a three-dimensional lookup table.

In the post-processing J0003, colors for reproducing the color gamut obtained as a result of the conversion are resolved into colors in the color gamut of ink. A process for obtaining 8-bit data C, M, Y, and K corresponding to the combinations between inks for reproducing the colors represented by the 8-bit data R, G, and B in the color gamut of the printer 104 obtained in the pre-processing J0002 is performed.

In the gamma correction J0004, gamma correction is performed for each piece of the 8-bit data C, M, Y, and K obtained as a result of the color resolution. Conversion is performed such that each piece of the 8-bit data C, M, Y, and K obtained by the post-processing J0003 is linearly associated with the tone characteristics of the printer 104.

In the binarization process J0005, a quantization process for converting the 8-bit data C, M, Y, and K obtained by the gamma correction J0004 into 1-bit data C, M, Y, and K is performed. In the quantization process, a density pattern method, a dithering method, an error diffusion method, or the like may be used.

In the process for creating print data J0006, 1-bit print data is created by adding printing control data or the like to data regarding an image including the 1-bit data C, M, Y, and K obtained by the binarization process J0005. The printing control data includes information regarding a print medium and information regarding printing quality.

The print data generated in the above-described manner is supplied to the printer 104.

In a mask data conversion process J0008, the print data created by the process for creating print data J0006 and input to the printer 104 is converted into print data indicating whether or not to form dots, that is, whether or not to eject ink using the overlap head 7, using the print data and data regarding a mask pattern, which will be described later.

The mask pattern is configured by arranging print permitting pixel data and print non-permitting pixel data in particular patterns. In the print permitting pixel data, input print data indicating ejection of ink is converted into print data for ejecting ink. On the other hand, in the print non-permitting pixel data, input print data indicating ejection of ink is converted into print data for inhibiting ejection of ink.

The mask pattern used in the mask data conversion process J0008 is stored in a certain memory of the printer 104 in advance.

The print data obtained by the mask data conversion process is supplied to a head driving circuit J0009 and a print head J0010. On the basis of this print data, the ejection ports 30 arranged in the overlap head 7 eject ink onto the print medium 3.

Mask patterns used in this embodiment will be described in detail hereinafter. In the following description, mask patterns used when printing is realized by performing three operations of print scanning in the unit region 76 will be described as has been described with reference to FIG. 5.

Figure 8A:
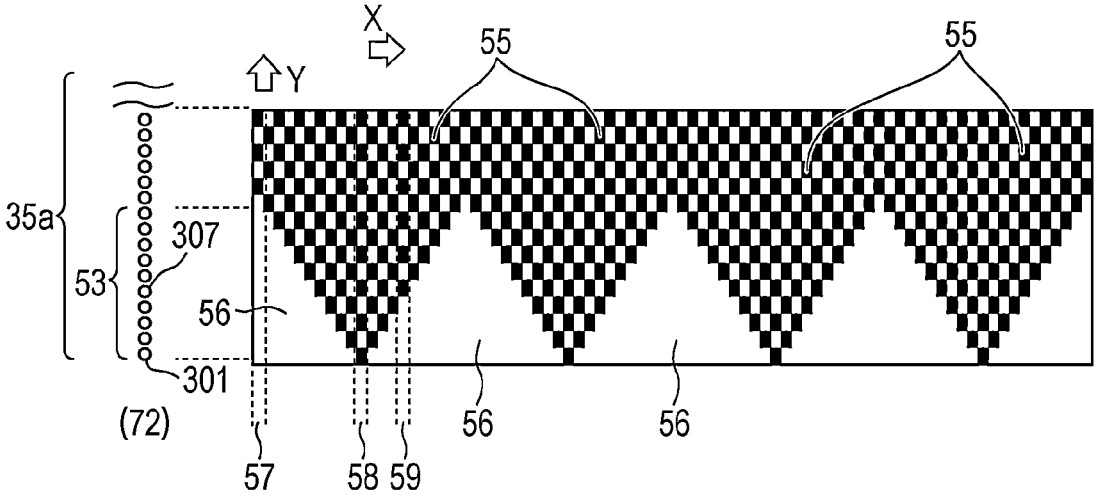
FIGS. 8A and 8B are diagrams illustrating mask patterns used for overlap portions of the overlap head according to the embodiments.
Figure 8B:
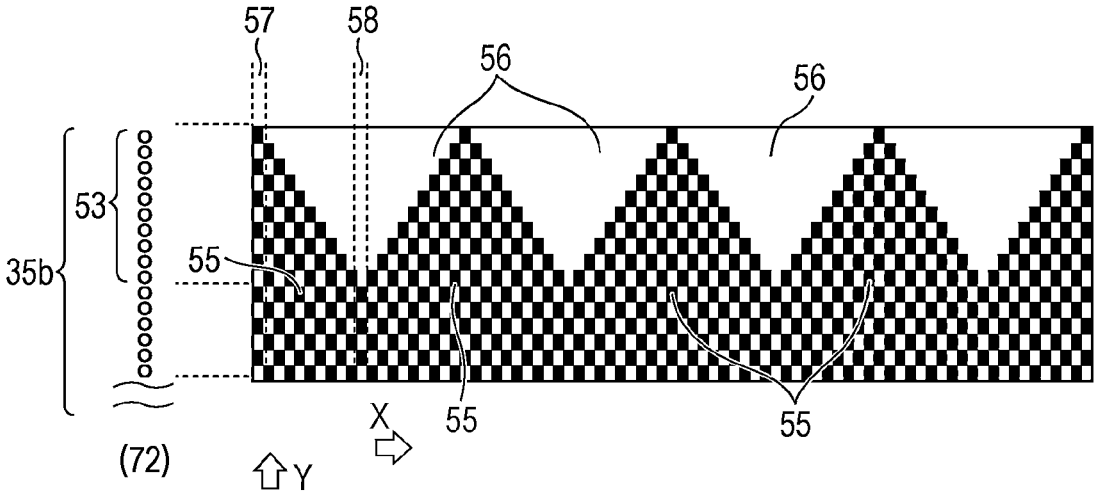

FIGS. 8A and 8B are diagrams illustrating mask patterns used in the overlap portion 53 of the overlap head 7 according to this embodiment.

In FIGS. 8A and 8B, black rectangles represent print permitting pixel data and white portions represent print non-permitting pixel data. The printing ratio of each nozzle that is included in a raster and that prints each pixel is determined on the basis of the arrangement of the print permitting pixel data and the print non-permitting pixel data.

As illustrated in FIG. 8A, a mask pattern corresponding to the ejection ports of the first ejection port array 35*a* in the overlap portion 53 and an area around the overlap portion 53 includes a region 55 in which the print permission ratio is set to 50%. The mask pattern also includes a region 56 in which the print permission ratio is set to 0% so that no ejection port performs printing. Here, in the region 55, in which the print permission ratio is set to 50%, pieces of print permitting pixel data and pieces of print non-permitting pixel data are alternately arranged in each of pixel columns including pixels arranged in the Y direction.

In a pixel column 57, which is printed immediately after the overlap head 7 begins to perform print scanning, none of the ejection ports of the first ejection port array 35*a* arranged in the overlap portion 53 performs printing. That is, the print permission ratio of a mask pattern corresponding to the ejection ports in the overlap portion 53 is 0%. Thereafter, as the position of the pixel column advances in the X direction one by one, the number of pixels of the region 55, whose print permission ratio is 50%, continuously increases one by one from downstream in the Y direction in the ejection ports of the first ejection port array 35*a* in the overlap portion 53, and the number of pixels of the region 56, whose print permission ratio is 0%, continuously decreases one by one. In a pixel column 58, all the ejection ports in the overlap portion 53 correspond to the region 55. In pixel columns located downstream of the pixel column 58 in the X direction, the number of pixels of the region 56 continuously increases one by one from upstream in the Y direction as the position of the pixel column advances, and the number of pixels of the region 55 continuously decreases one by one.

As described above, in the mask pattern used for the ejection ports of the first ejection port array 35*a* in the overlap portion 53, the printing ratio of M ($0 \leq M \leq 10$) ejection ports located upstream in the Y direction is set to 0% at the position of each pixel column in the X direction, and the printing ratio of 10−M ejection ports located downstream in the Y direction is set to 50% at the position of each pixel column. As the position of the pixel column advances in the X direction one by one, the value of M continuously increases or decreases one by one in a range of 0 to 10.

On the other hand, FIG. 8B is a schematic diagram illustrating a mask pattern used for the ejection ports of the second ejection port array 35*b* in the overlap portion 53 and an area around the overlap portion 53. As illustrated in FIG. 8B, the mask pattern for the ejection ports of the second ejection port array 35*b* in the overlap portion 53 is a pattern obtained by switching the positions of the regions 55 and 56 of the mask pattern used for the ejection ports of the first ejection port array 35*a* in the overlap portion 53.

That is, in the mask pattern used for the ejection ports of the second ejection port array 35*b* in the overlap portion 53, the printing ratio of 10−M ejection ports located downstream in the Y direction is set to 0% at the position of each pixel column in the X direction, and the printing ratio of M ejection ports located upstream in the Y direction is set to 50% at the position of each pixel column. As the position of the pixel column advances in the X direction one by one, the value of M continuously increases or decreases one by one in the range of 0 to 10.

Figure 9:
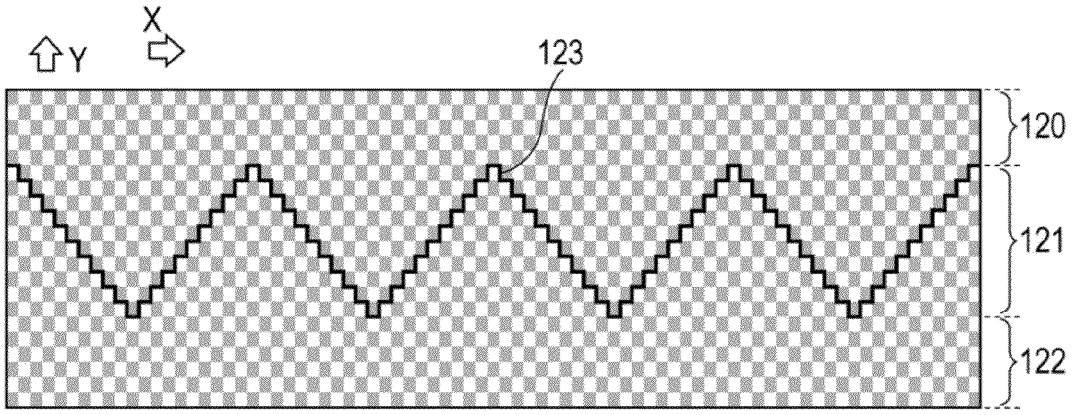
FIG. 9 is a diagram illustrating an image printed on the print medium according to the embodiments.

FIG. 9 is a schematic diagram illustrating a portion of an image printed on the print medium 3 by one operation of print scanning of the overlap head 7 in which printing has been performed by the overlap portion 53 and the area around the overlap portion 53.

A region 121 is a region in which the first ejection port array 35*a* and the second ejection port array 35*b* belonging to the overlap portion 53 have performed printing. On the other hand, a region 120 is a region in which a non-overlap portion of the first ejection port array 35*a* has performed printing, and a region 122 is a region in which a non-overlap portion of the second ejection port array 35*b* has performed printing.

Here, as illustrated in FIG. 9, the position of a boundary 123 (solid line) between dots printed as a result of ejection of ink from the first ejection port array 35*a* and dots printed as a result of ejection of ink from the second ejection port array 35*b* in the region 121 continuously changes in the Y direction as the position of the boundary 123 changes in the X direction. As a result, the boundary 123 has a shape of triangular waves. Therefore, even if unevenness occurs in the portion in which the overlap portion 53 has performed printing, the unevenness does not stand out compared to a case in which a linear boundary is formed between dots printed by two ejection port arrays in an overlap portion.

Figure 10A:
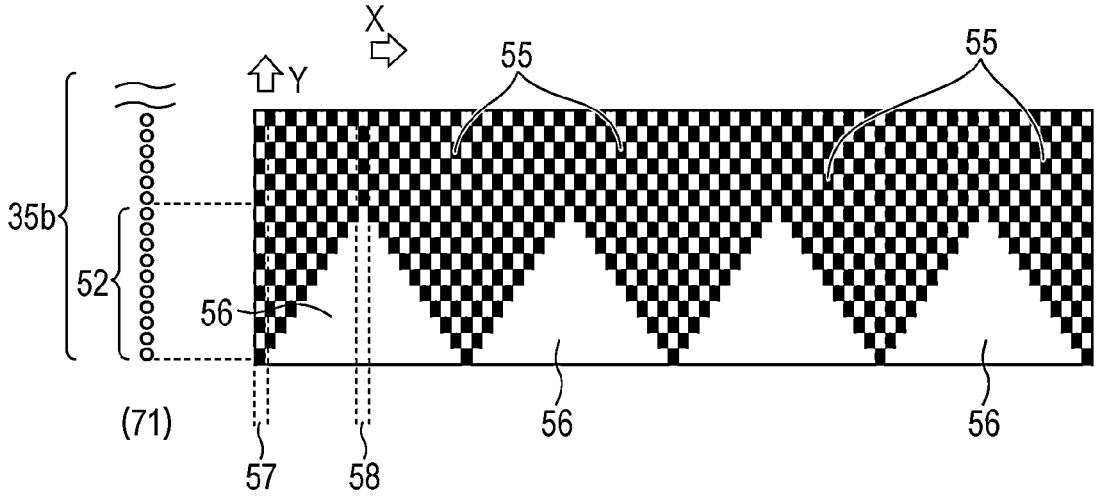
FIGS. 10A and 10B are diagrams illustrating mask patterns used for ends of the overlap head according to a first embodiment.
Figure 10B:
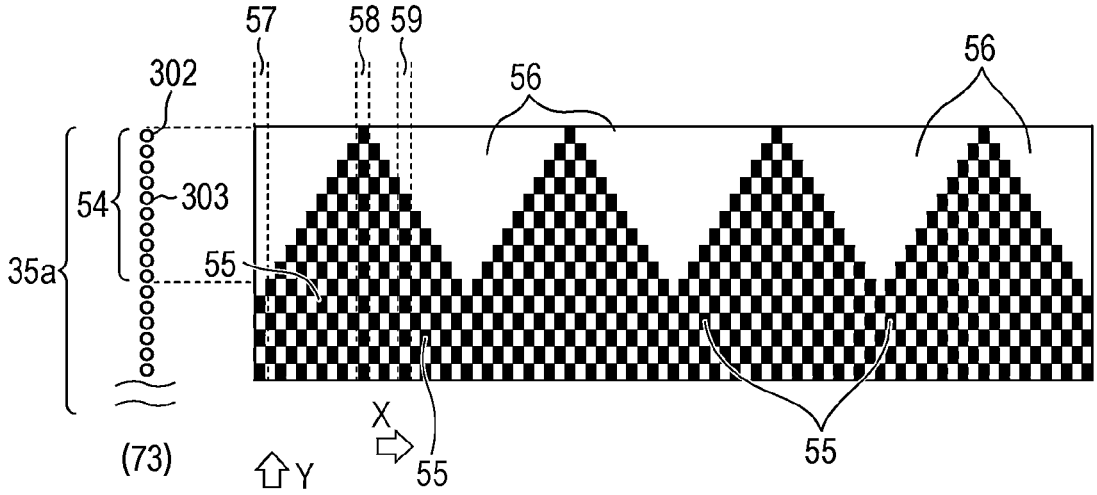

FIG. 10A is a schematic diagram illustrating a mask pattern used for the certain number of ejection ports of the second ejection port array 35*b* arranged in the upstream end portion 52 in the Y direction and an area around the upstream end portion 52. FIG. 10B is a schematic diagram illustrating a mask pattern used for the certain number of ejection ports of the first ejection port array 35*a* arranged in the downstream end portion 54 in the Y direction and an area around the downstream end portion 54.

As illustrated in FIG. 10A, among the ejection ports of the second ejection port array 35*b* in the upstream end portion 52 in the Y direction, the printing ratio of K ($0 \leq K \leq 10$) ejection ports located upstream in the Y direction is set to 0% at the position of each pixel column in the X direction, and the printing ratio of 10−K ejection ports located downstream in the Y direction is set to 50% at the position of each pixel column. As the position of the pixel column advances in the X direction one by one, the value of K continuously increases or decreases one by one in the range of 0 to 10.

Here, the print permitting pixel data is arranged such that the position of the boundary between the region 55, in which the print permission ratio is 50%, and the region 56, in which the print permission ratio is 0%, becomes different between the mask pattern illustrated in FIG. 10A and the mask pattern illustrated in FIG. 8A.

In addition, as illustrated in FIG. 10B, the mask pattern used for the ejection ports of the first ejection port array 35*a* arranged in the downstream end portion 54 is a pattern obtained by switching the positions of the regions 55 and 56 of the mask pattern used for the ejection ports of the second ejection port array 35*b* arranged in the upstream end portion 52. That is, among the ejection ports of the first ejection port array 35*a* in the downstream end portion 54 in the Y direction, the printing ratio of 10−K ejection ports located downstream in the Y direction is set to 0% at the position of each pixel column in the X direction, and the printing ratio of K ejection ports located upstream in the Y direction is set to 50% at the position of each pixel column. As the position of the pixel column advances in the X direction one by one, the value of K continuously increases or decreases one by one in the range of 0 to 10.

Figure 11A:
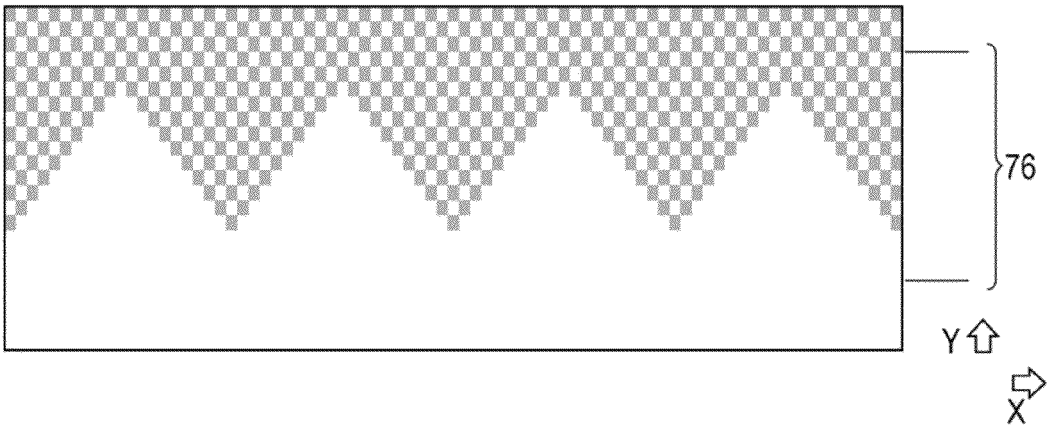
FIGS. 11A to 11C are diagrams illustrating a process for forming a complete image in a unit region of the print medium according to the first embodiment.
Figure 11B:
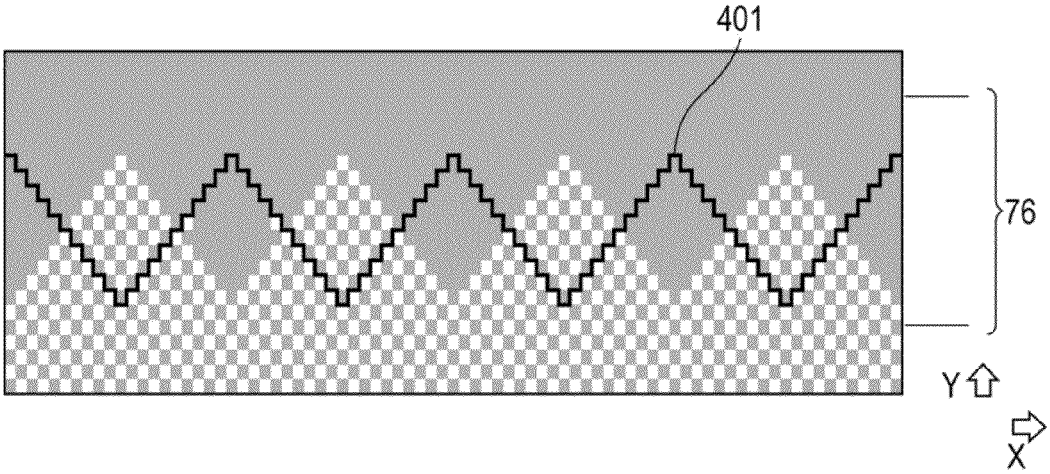
Figure 11C:
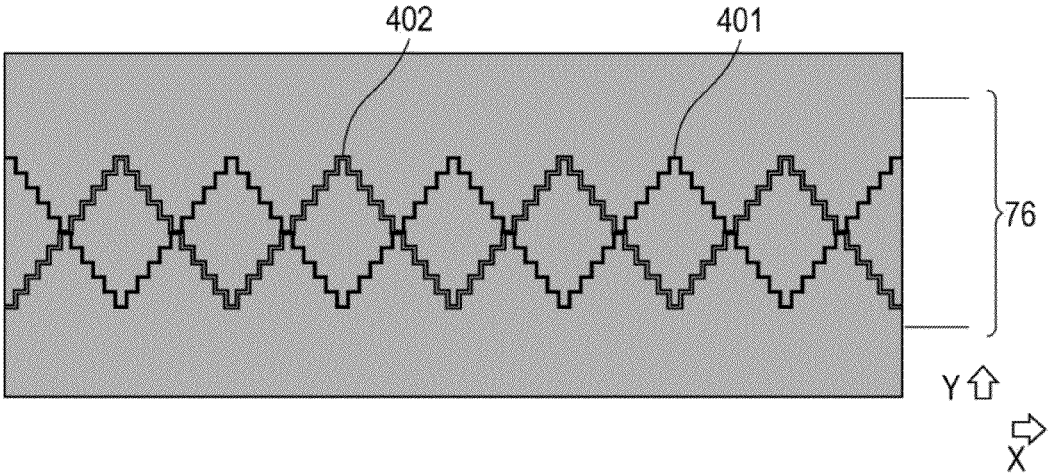

FIGS. 11A to 11C are diagrams illustrating a process for forming an image in the region 76 illustrated in FIG. 5 and an area around the region 76 at a time when printing is performed using the mask patterns according to this embodiment.

The unit region 76 of the print medium 3 is a region in which printing is performed by the ejection ports of the second ejection port array 35*b* in the upstream end portion 52 in the first operation of print scanning, the ejection ports of the first and second ejection port arrays 35*a* and 35*b* in the overlap portion 53 in the next operation of print scanning, and the ejection ports of the first ejection port array 35*a* in the downstream end portion 54 in the third operation of print scanning.

A mode will be described in which a so-called "solid image", which is obtained by printing dots at all pixels in the unit region 76 using ink, is printed in the region 76 as a printed image to be obtained through the three operations of print scanning.

First, the second ejection port array 35*b* performs printing in accordance with the mask pattern illustrated in FIG. 10A. As a result, as illustrated in FIG. 11A, ink is ejected onto the print medium 3 at pixels at the positions of the print permitting pixel data of the mask pattern, and dots are printed.

In the next operation of print scanning, the ejection ports of the first ejection port array 35*a* and the second ejection port array 35*b* in the overlap portion 53 perform printing in accordance with the mask patterns illustrated in FIGS. 8A and 8B. The image described with reference to FIG. 9, which reflects the mask patterns illustrated in FIGS. 8A and 8B, is printed on the printed image obtained in the first operation of print scanning. As a result, a pattern illustrated in FIG. 11B is formed in the region 76 and the areas around the region 76 as an image obtained until this stage. Here, a first boundary 401, which is a boundary between the dots (corresponds to the region 55 of the mask pattern illustrated in FIG. 8A) printed by the ejection of ink from the ejection ports of the first ejection port array 35*a* in the overlap portion 53 and the dots (corresponds to the region 55 of the mask pattern illustrated in FIG. 8B) printed by the ejection of ink from the ejection ports of the second ejection port array 35*b* in the overlap portion 53, has the shape of triangular waves. The shape of the boundary 401 corresponds to the increases and the decreases in the above-described value of M. Even if an error occurs in the arrangement of the first ejection port array 35*a* and the second ejection port array 35*b* in the overlap head 7, unevenness occurs along the shape of triangular waves that reflects the continuous increases and decreases in the value of M in the scanning as indicated by the boundary 401, and accordingly the unevenness does not stand out.

In the third operation of print scanning, the ejection ports of the first ejection port array 35*a* in the downstream end portion 54 perform printing, in accordance with the mask pattern illustrated in FIG. 10B, at pixels at which printing has not been performed, and a complete image is formed in the unit region 76 of the print medium 3. As illustrated in FIG. 11C, after the third operation of print scanning, ink has been ejected at all the pixels in the unit region 76 of the print medium 3. Here, the shape of a second boundary 402, which is a boundary between the dots (corresponds to the region 55 of the mask pattern illustrated in FIG. 10A) printed by the ejection of ink from the ejection ports of the second ejection port array 35*b* in the upstream end portion 52 in the first operation of print scanning and the dots (corresponds to the region 55 of the mask pattern illustrated in FIG. 10B) printed by the ejection of ink from the ejection ports of the first ejection port array 35*a* in the downstream end portion 54 in the third operation of print scanning, is the same shape of triangular waves as that of the boundary 401. The position at which this shape is formed is different from the position at which the shape of the boundary 401 is formed in the X direction, that is, the phases of the triangular waves of the boundary 401 and the boundary 402 are different. The shape of the boundary 402 corresponds to the continuous increases and decreases in the above-described value of K. Even if the print medium 3 deviates from a normal position as a result of conveying before an operation of print scanning or even if ink blurs into an image printed in a previous operation of print scanning, unevenness occurs along the shape of triangular waves that reflects the continuous increases and decreases in the value of K in the scanning as indicated by the boundary 402, and accordingly the unevenness does not stand out.

According to the above-described configuration, the first boundary 401 between images printed by the two ejection port array in the overlap portion 53 of the overlap head 7 and the boundary 402, which corresponds to a boundary between images printed in two different operations of print scanning are formed such that the phases of the boundaries 401 and 402 become different. Therefore, even if unevenness occurs along the shapes of the two boundaries 401 and 402, the unevenness is not accentuated by each other and an uneven appearance may be suppressed, thereby keeping the unevenness from standing out. In other words, since the values of M and K increase and decrease in different ways because of the different printing positions in the X direction, the effect upon image quality may be suppressed even if unevenness occurs in an overlap portion between ejection port arrays or a stripe occurs between images printed by two different operations of print scanning.

Second Embodiment

In the first embodiment, a mode has been described in which the shape of a boundary between images printed by two ejection port arrays in the overlap portion 53 and the shape of a boundary between images printed by different operations of print scanning are the same but the phases of these boundaries are different.

In a second embodiment, a mode will be described in which the amounts of changes (hereinafter also referred to as amplitudes) of two boundaries at positions in the Y direction are different.

As in the first embodiment, a mode will be described in this embodiment in which a complete image is formed in the unit region 76 of the print medium 3 by three operations of print scanning.

In this embodiment, as in the first embodiment, the mask patterns illustrated in FIGS. 8A and 8B are used for the first ejection port array 35*a* and the second ejection port array 35*b* in the overlap portion 53 and the area around the overlap portion 53.

That is, in the mask pattern used for the ejection ports of the first ejection port array 35*a* in the overlap portion 53, the printing ratio of the M ($0 \leq M \leq 10$) ejection ports located upstream in the Y direction is set to 0% at the position of each pixel column in the X direction, and the printing ratio of the 10−M ejection ports located downstream in the Y direction is set to 50% at the position of each pixel column. As the position of the pixel column advances in the X direction one by one, the value of M continuously increases or decreases one by one in the range of 0 to 10.

In addition, in the mask pattern used for the ejection ports of the second ejection port array 35*b* in the overlap portion 53, the printing ratio of the 10−M ejection ports located downstream in the Y direction is set to 0% at the position of each pixel column in the X direction, and the printing ratio of the M ejection ports located upstream in the Y direction is set to 50% at the position of each pixel column. As the position of the pixel column advances in the X direction one by one, the value of M continuously increases or decreases one by one in the range of 0 to 10.

Figure 12A:
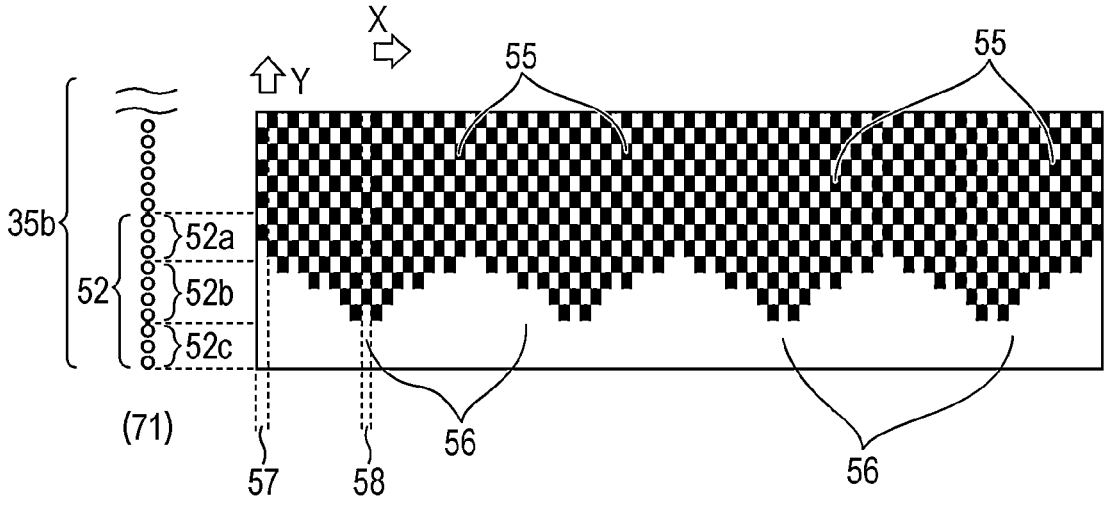
FIGS. 12A and 12B are diagrams illustrating mask patterns used for ends of the overlap head according to a second embodiment.
Figure 12B:
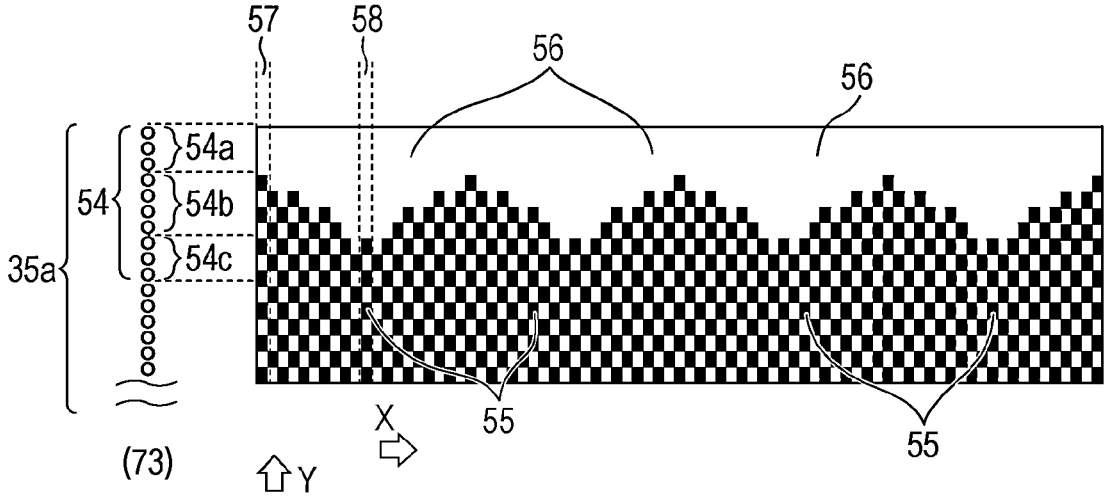

FIG. 12A is a schematic diagram illustrating a mask pattern used for the certain number of ejection ports of the second ejection port array 35*b* arranged in the upstream end portion 52 in the Y direction and the area around the upstream end portion 52. FIG. 12B is a schematic diagram illustrating a mask pattern used for the certain number of ejection ports of the first ejection port array 35*a* arranged in the downstream end portion 54 in the Y direction and the area around the downstream end portion 54.

As illustrated in FIG. 12A, a mask pattern that causes the boundary between the region 55, in which the print permission ratio is 50%, and the region 56, in which the print permission ratio is 0%, to have a shape of triangular shapes is used for the ejection ports of the second ejection port array 35*b* in the upstream end portion 52 in the Y direction. However, the amplitude of the shape of waves of this boundary is smaller than that of the shape of waves of the boundary between the region 55 and the region 56 of the mask pattern used for the ejection ports of the first ejection port array 35*a* in the overlap portion 53 illustrated in FIG. 8A.

Therefore, the position of the boundary between the region 55, in which the print permission ratio is 50%, and the region 56, in which the print permission ratio is 0%, is different between the mask pattern illustrated in FIG. 12A and the mask pattern illustrated in FIG. 8A.

More specifically, the mask pattern illustrated in FIG. 12A is divided into three partial patterns, namely a partial pattern corresponding to three pixels in a downstream region 52*a*, a partial pattern corresponding to four pixels in a central region 52*b*, and a partial pattern corresponding to three pixels in an upstream region 52*c*.

For the three pixels in the downstream region 52*a*, a partial pattern that establishes the region 55, in which the print permission ratio continuously remains at 50%, is used. For the three pixels in the upstream region 52*c*, a partial pattern that fixes the print permission ratio to 0% is used.

For the four pixels in the central region 52*b*, a partial pattern that includes the region 55, in which the print permission ratio is set to 50%, and the region 56, in which the print permission ratio is set to 0%, is used. The partial pattern corresponding to the central region 52*b* becomes the region 56, in which the printing ratio is 0%, for all the ejection ports in the pixel column 57, which is printed immediately after the beginning of the print scanning. Thereafter, each time the position of the pixel column advances by two or three pixels in the X direction, the number of pixels of the region 55 increases from downstream in the Y direction by one pixel, and accordingly the number of pixels of the region 56 decreases by one pixel. In the pixel column 58, an ejection port located at an upstream end of the central region 52*b* corresponds to the region 56. Furthermore, in the pixel columns located downstream of the pixel column 58 in the X direction, the number of pixels of the region 56 increases by one pixel to downstream in the Y direction each time the position of the pixel column advances by two or three pixels, and accordingly the number of pixels of the region 55 decreases by one pixel.

As described above, in the mask pattern used for the ejection ports of the second ejection port array 35*b* in the upstream end portion 52, the printing ratio of K ($3 \leq K \leq 7$) ejection ports located upstream in the Y direction is set to 0% at the position of each pixel column in the X direction, and the printing ratio of 10−K ejection ports located downstream in the Y direction is set to 50% at the position of each pixel. Each time the position of the pixel column advances in the X direction by two or three pixels, the value of K increases or decreases by one in a range of 3 to 7.

As in the first embodiment, the print permitting pixel data is arranged such that the position of the boundary between the region 55, in which the print permission ratio is 50%, and the region 56, in which the print permission ratio is 0%, becomes different between the mask pattern illustrated in FIG. 12A and the mask pattern illustrated in FIG. 8A.

That is, in the same pixel column, the value of K in the mask pattern illustrated in FIG. 12A and the value of M in the mask pattern illustrated in FIG. 8A are different. For example, in the pixel column 57, M=10 and K=7, and in the pixel column 58, M=0 and K=3.

On the other hand, the mask pattern illustrated in FIG. 12B is divided into three partial patterns, namely a partial pattern corresponding to three pixels in a downstream region 54*a*, a partial pattern corresponding to four pixels in a central region 54*b*, and a partial pattern corresponding to three pixels in an upstream region 54*c*.

For the three pixels in the downstream region 54*a*, a partial pattern that establishes the region 56, in which the print permission ratio is set to 0%, is used. For the three pixels in the upstream region 54*c*, a partial pattern that establishes the region 55, in which the print permission ratio is set to 50%, is used.

For the four pixels in the central region 54*b*, a partial pattern obtained by switching the positions of the regions 55 and 56 of the mask pattern used for the central region 52*b* of the second ejection port array 35*b* is used.

As described above, in the mask pattern used for the ejection ports of the second ejection port array 35*b* in the downstream end portion 54 in the Y direction, the printing ratio of 10−K ($3 \leq K \leq 7$) ejection ports located downstream in the Y direction is set to 0% at the position of each pixel column in the X direction, and the printing ratio of K ejection ports located upstream in the Y direction is set to 50% at the position of each pixel. Each time the position of the pixel column advances in the X direction by two or three pixels, the value of K increases or decreases by one in a range of 3 to 7.

Figure 13A:
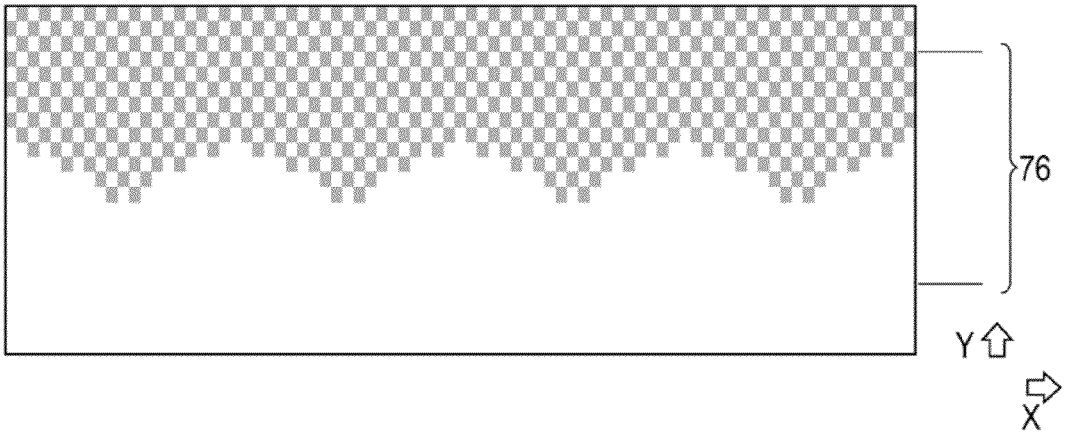
FIGS. 13A to 13C are diagrams illustrating a process for forming a complete image in a unit region of the print medium according to the second embodiment.
Figure 13B:
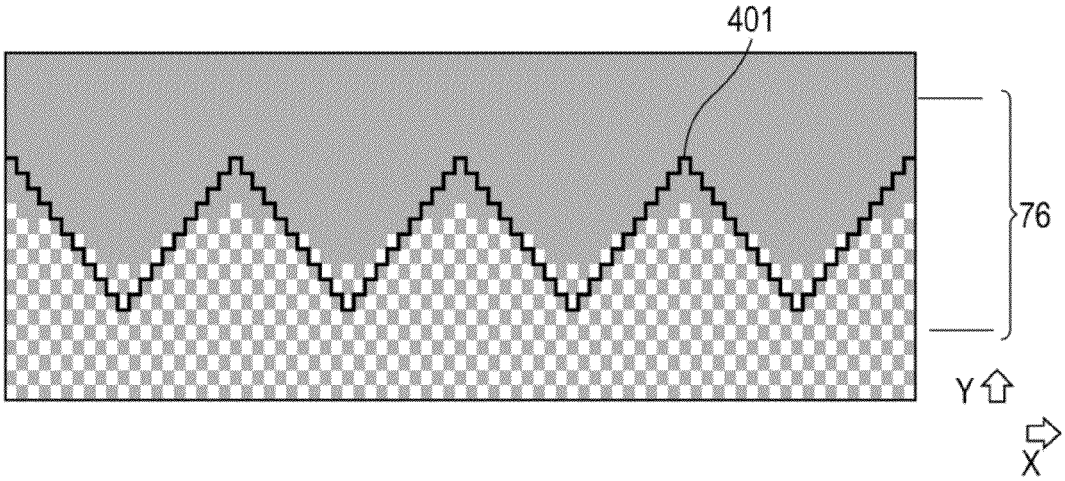
Figure 13C:
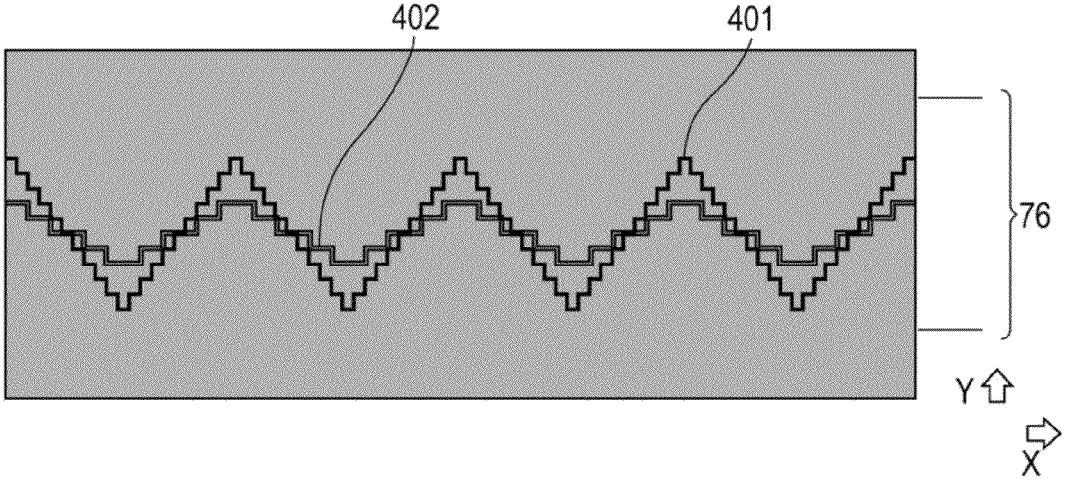

FIGS. 13A to 13C are diagrams illustrating a process for forming an image in the region 76 illustrated in FIG. 5 and the area around the region 76 at a time when printing is performed using the mask patterns according to this embodiment.

First, the ejection ports of the second ejection port array 35*b* in the upstream end portion 52 in the Y direction perform printing in accordance with the mask pattern illustrated in FIG. 12A. As a result, as illustrated in FIG. 13A, printing is performed on the print medium 3 at pixels at positions corresponding to the print permitting pixel data of the mask pattern.

In the next operation of print scanning, the ejection ports of the first ejection port array 35*a* and the second ejection port array 35*b* in the overlap portion 53 perform printing in accordance with the mask patterns illustrated in FIGS. 8A and 8B. After this operation of print scanning, a pattern illustrated in FIG. 13B is formed in the region 76 and the area around the region 76 as an image obtained until this stage. Here, the first boundary 401, which is a boundary between the dots printed by the ejection of ink from the ejection ports of the first ejection port array 35*a* in the overlap portion 53 and the dots printed by the ejection of ink from the ejection ports of the second ejection port array 35*b* in the overlap portion 53, has the shape of triangular waves.

In the third operation of print scanning, the ejection ports of the first ejection port array 35*a* in the downstream end portion 54 in the Y direction perform printing, in accordance with the mask pattern illustrated in FIG. 12B, at pixels at which printing has not been performed, and a complete image is formed in the unit region 76 of the print medium 3. As illustrated in FIG. 13C, after the third operation of print scanning, ink has been ejected onto the print medium 3 at all the pixels in the unit region 76. Here, the shape of a second boundary 402, which is a boundary between the dots (corresponds to the region 55 of the mask pattern illustrated in FIG. 12A) printed by the ejection of ink from the ejection ports of the second ejection port array 35*b* in the upstream end portion 52 in the Y direction in the first operation of print scanning and the dots (corresponds to the region 55 of the mask pattern illustrated in FIG. 12B) printed by the ejection of ink from the ejection ports of the first ejection port array 35*a* in the downstream end portion 54 in the Y direction in the third operation of print scanning, is a shape of triangular waves similar to that of the triangular waves of the boundary 401 and the phase of the second boundary 402 is the same as that of the first boundary 401. However, the amplitude of the second boundary 402 is smaller than that of the first boundary 401.

According to the above-described configuration, as in the first embodiment, printing may be performed such that the first boundary 401 between images printed by the two ejection port arrays in the overlap portion 53 of the overlap head 7 and the second boundary 402 between images printed in two different operations of print scanning do not match on the print medium 3. Therefore, unevenness that occurs on the print medium 3 may be kept from standing out.

As described above, according to the printing apparatus disclosed in the present invention, even if unevenness caused by the overlap portion 53 of the overlap head 7 and unevenness caused by a deviation between operations of scanning occur, it is possible to suppress deterioration of image quality because these two types of unevenness have different shapes.

Although mask patterns that cause the shapes of the boundaries 401 and 402 to be triangular waves have been used in the above-described embodiments, the shapes of the boundaries 401 and 402 are not necessarily limited to triangular waves insofar as the positions of the boundaries 401 and 402 continuously change in the Y direction to a certain extent as the positions of the boundaries 401 and 402 change in the X direction. For example, the shapes of the boundaries 401 and 402 may be sine waves or saw teeth, instead. In addition, the shapes of the boundaries 401 and 402 need not necessarily be periodical pattern shapes insofar as the positions of the boundaries 401 and 402 become different in the Y direction as the positions of the boundaries 401 and 402 change in the X direction.

Figure 1:
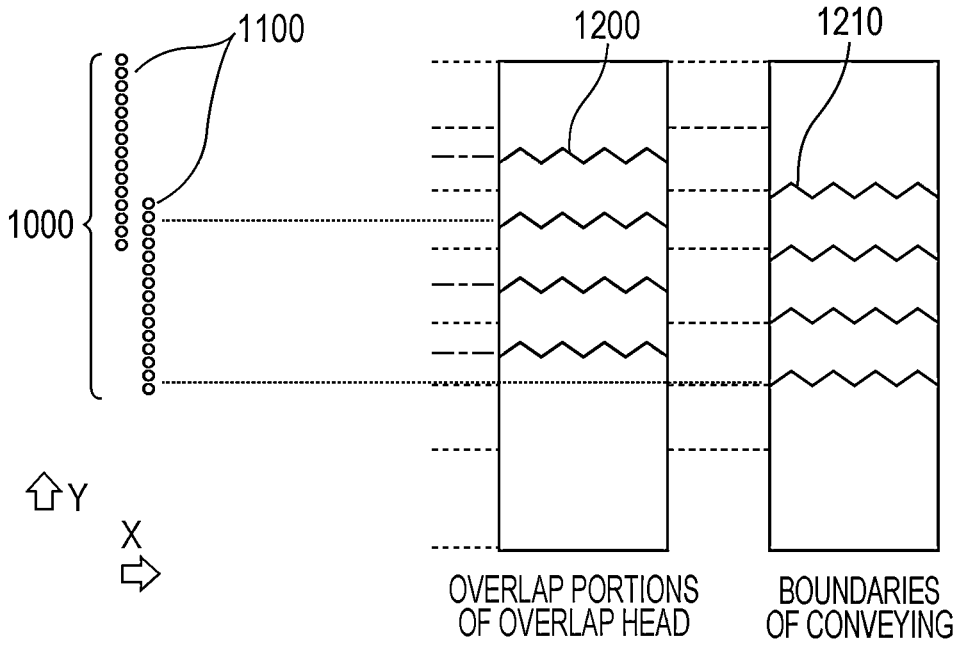
FIG. 1 is a diagram illustrating a problem to be solved by the present invention.

Although a mode in which unevenness caused by the overlap portion 53 of the overlap head 7 and unevenness caused by a deviation between operations of scanning occur in the same unit region 76 of the print medium 3 has been described in the above-described embodiments, the present invention may be implemented in another mode. As illustrated in FIG. 1, even when unevenness caused by an overlap portion of an overlap head and unevenness caused by a deviation between operations of scanning occur in different regions of the print medium 3, the pattern shapes of these two types of unevenness are undesirably accentuated by each other due to the visual characteristics of humans if the shapes of these two types of unevenness are the same, although these two types of unevenness do not stand out strongly compared to when these two types of unevenness occur in the same region. Therefore, even when these two types of unevenness occur in different regions of a print medium, the same effect of the present invention may be produced by making the pattern shapes of these two types of unevenness different from each other.

Although a mode in which unevenness caused by the overlap portion 53 of the overlap head 7 and unevenness caused by a deviation between operations of scanning are formed by the ejection from the first and second ejection port arrays 35*a* and 35*b* has been described in the above-described embodiments, the present invention may be implemented in another mode.

Figure 14:
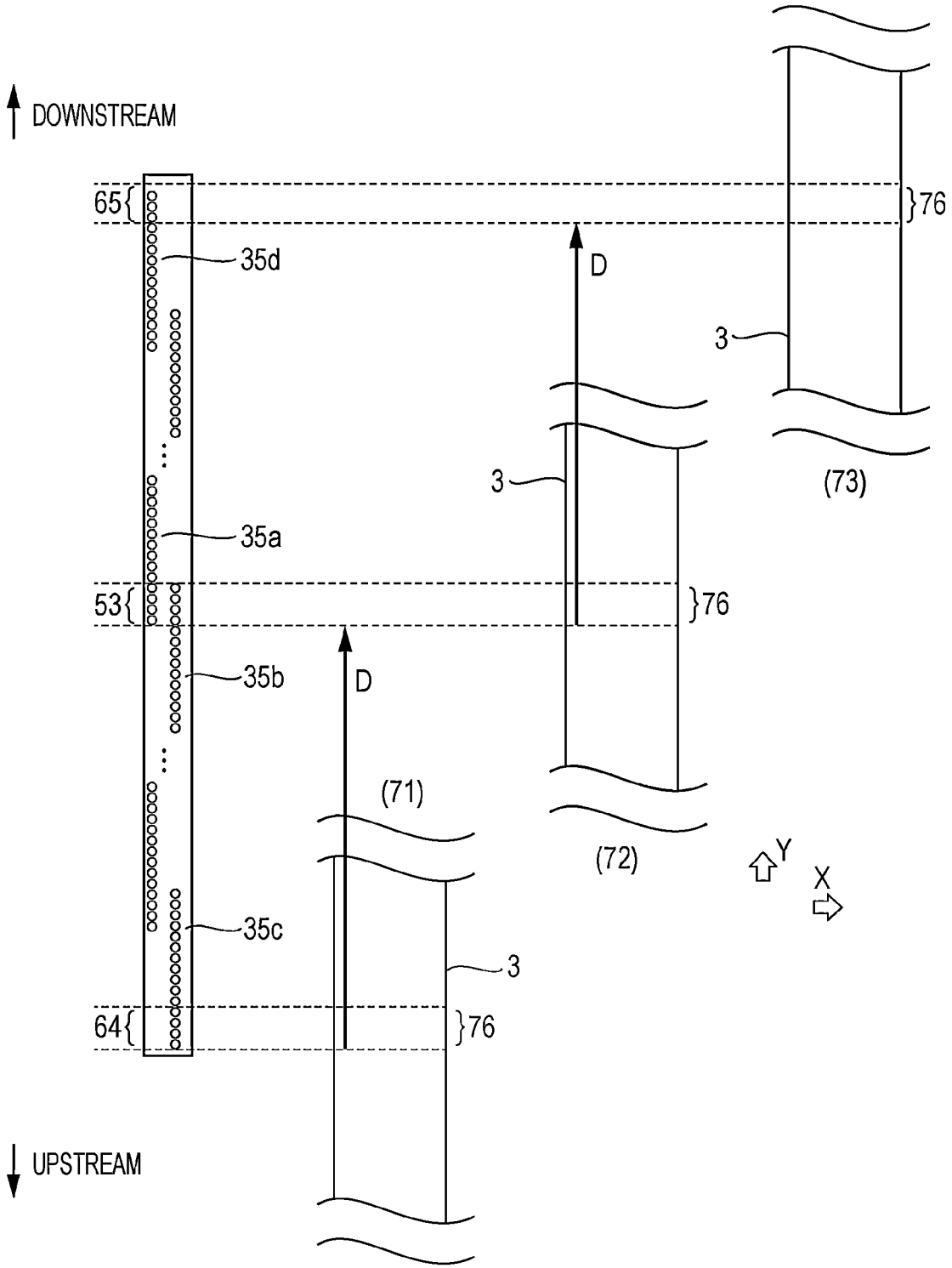
FIG. 14 is a diagram illustrating another printing method to which the present invention may be applied.

FIG. 14 is a diagram illustrating an example of another embodiment to which the present invention may be applied. Here, as illustrated in FIG. 14, an overlap head including a third ejection port array 35*c* located upstream of the second ejection port array 35*b* in the Y direction and a fourth ejection port array 35*d* located downstream of the first ejection port array 35*a* in the Y direction in addition to the first and second ejection port arrays 35*a* and 35*b* is used. In the first operation of scanning, ejection ports of the third ejection port array 35*c* in a non-overlap portion 64 located upstream in the Y direction eject ink onto the unit region 76. In the second operation of print scanning, the ejection ports of the first and second ejection port arrays 35*a* and 35*b* in the overlap portion 53 eject ink onto the unit region 76. In the third operation of print scanning, ejection ports of the fourth ejection port array 35*d* in a non-overlap portion 65 located downstream in the Y direction eject ink onto the unit region 76. In this case, the boundary between images formed in the unit region 76 by the ejection of ink from the ejection ports of the first and second ejection port arrays 35*a* and 35*b* in the overlap portion 53 in the second operation of print scanning and a boundary between images formed in the unit region 76 by the ejection of ink from the ejection ports of the third and fourth ejection port arrays 35*c* and 35*d* in the non-overlap portions 64 and 65 in the first and third operations of print scanning, respectively, may have different shapes. Although a case in which the print medium 3 is conveyed such that the ejection ports of the first and second ejection port arrays 35*a* and 35*b* in the overlap portion 53 and the ejection ports of the third and fourth ejection port arrays 35*c* and 35*d* in the non-overlap portions 64 and 65, respectively, eject ink onto the same unit region 76 in the second operation of print scanning and the first and third operations of print scanning, respectively, has been described above, the present invention may also be applied to a case in which the print medium 3 is conveyed such that the overlap portion 53 and the non-overlap portions 64 and 65 eject ink onto different unit regions.

Although a mode in which the values of M and K continuously increase or decrease one by one has been described in the above-described embodiments, another mode may be adopted, instead. With respect to the shape of continuous changes in a boundary, the effect of the present invention may be produced insofar as the shape of a boundary does not sharply change in the Y direction between two pixel columns adjacent to each other in the X direction. More specifically, when ejection port arrays in which a plurality of ejection ports are arranged at a density of 600 dpi are used, a maximum value of a difference between the values of M and a maximum value of a difference between the values of K of two adjacent pixel columns in a unit region may be smaller than or equal to 3 (corresponds to about 120 μm). On the other hand, when ejection port arrays in which a plurality of ejection ports are arranged at a density of 1,200 dpi are used, the maximum value of the difference between the values of M and the maximum value of the difference between the values of K of two adjacent pixel columns may be smaller than or equal to 6 (corresponds to about 120 μm).

Although a mode in which ten ejection ports are included in each of the first and second ejection port arrays 35*a* and 35*b* the overlap portion 53 has been described in the above-described embodiments, the present invention sufficiently produces the effect thereof insofar as N ejection ports located at one end of a first ejection port array and N ejection ports located at another end of a second ejection port array are arranged in such a way as to form the same N pixel rows on a print medium. As a result of examinations made by the inventors, however, it has been found out that when the number of ejection ports of each of ejection port arrays arranged in an overlap portion is ten or more, the amplitude of the shape of a boundary between the ejection port arrays on a print medium becomes large, and accordingly the present invention produces a significant effect.

Although a mode in which a complete image is formed in the unit region 76 of the print medium 3 by the three operations of print scanning has been described in the above-described embodiments, the number of operations of print scanning in the present invention may be arbitrarily determined, obviously.

Alternatively, the boundary 401 and the boundary 402 may be formed in such a way as to include no matching point or intersection on the print medium 3, that is, the boundary 401 and the boundary 402 may be formed apart from each other in the Y direction. In this case, too, deterioration of image quality may be kept from standing out by making the changing patterns of the positions of the two boundaries in an array direction different from each other in accordance with a printing position in a scanning direction, and the effect of the present invention may be produced.

Although printing is controlled using mask patterns in the above-described embodiments, the present invention may be sufficiently applied insofar as each pixel includes a unit capable of performing printing, and the unit is not limited to a mask pattern. For example, the effect of the present invention may be produced in a mode in which printing is controlled by sequentially determining, for each raster, in which operation of print scanning each pixel performs printing.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to a printing control apparatus and the printing apparatus according to the embodiments of the present invention, it is possible to print an image in which unevenness that has occurred on a print medium does not stand out.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-288235 filed Dec. 28, 2012, which is hereby incorporated by reference herein in its entirety.

What is claimed is:

1. A printing control apparatus that performs control for printing an image using a print head that includes a plurality of ejection port arrays including at least a first ejection port array in which a plurality of ejection ports which eject ink of the same color are arranged in a certain array direction and a second ejection port array which is adjacent to the first ejection port array in the array direction and in which a plurality of ejection ports which eject ink of the same color are arranged in the array direction and in which the plurality of ejection port arrays are arranged in the array direction such that one ejection port array and another ejection port array adjacent to each other in the array direction are arranged at different positions in the array direction and different positions in a cross direction, which is crossing to the array direction, so that N ejection ports, N being larger than zero, located at an end of the one ejection port array on a side of the other ejection port array in the array direction and N ejection ports located at an end of the other ejection port array on a side of the one ejection port array in the array direction form an overlap portion capable of performing printing in the same region of a print medium, the printing control apparatus comprising:

a scanning unit configured to scan the print head and the print medium in the cross direction relative to a unit region of the print medium;

a conveying unit configured to convey, between operations of the scanning performed by the scanning unit, the print medium in a conveying direction, which is crossing to the cross direction, by a distance corresponding to a length smaller than a length of a range of the print head in which the ejection ports are arranged; and an ejection control unit configured to perform control such that ink is ejected onto the unit region at a certain printing ratio in each of a plurality of operations of the scanning, wherein the conveying unit conveys the print medium such that the overlap portion between the first and second ejection port arrays corresponds to a first unit region in a first operation of the scanning among the plurality of operations of the scanning performed by the scanning unit, such that N ejection ports in a first non-overlap portion other than the overlap portions between the plurality of ejection port arrays correspond to a second unit region in a second operation of the scanning different from the first operation of the scanning among the plurality of operations of the scanning performed by the scanning unit, and such that N ejection ports in a second non-overlap portion other than the overlap portions between the plurality of ejection port arrays correspond to the second unit region in a third operation of the scanning different from the first and second operations of the scanning among the plurality of operations of the scanning performed by the scanning unit, wherein, in order to print, in the cross direction, a plurality of pixel columns including a plurality of pixels arranged in the array direction in the first and second unit regions, the ejection control unit performs control such that, (i) when the ejection ports of the first and second ejection port arrays in the overlap portion perform printing in the first unit region in the first operation of the scanning, M of the N ejection ports of the first ejection port array in the overlap portion, M being equal to or larger than zero but smaller than or equal to N, closest to the second ejection port array in the array direction do not eject ink, N−M ejection ports of the first ejection port array in the overlap portion farthest from the second ejection port array in the array direction eject ink at a first printing ratio, N−M of the N ejection ports of the second ejection port array in the overlap portion closest to the first ejection port array in the array direction do not eject ink, and M ejection ports of the second ejection port array in the overlap portion farthest from the first ejection port array in the array direction eject ink at the first printing ratio, (ii) when the ejection ports in the first non-overlap portion perform printing in the second unit region in the second operation of the scanning, K of the N ejection ports in the first non-overlap portion, K being equal to or larger than zero but smaller than or equal to N, closest to the second non-overlap portion in the array direction do not eject ink and N−K ejection ports in the first non-overlap portion farthest from the second non-overlap portion in the array direction eject ink at a second printing ratio, and (iii) when the ejection ports in the second non-overlap portion perform printing in the second unit region in the third operation of the scanning, N−K of the N ejection ports in the second non-overlap portion closest to the first non-overlap portion in the array direction do not eject ink and K ejection ports in the second non-overlap portion farthest from the first non-overlap portion in the array direction eject ink at the second printing ratio, wherein M and K continuously increase or decrease as a position of the pixel column in the first and second unit regions, respectively, changes in the cross direction, and wherein, when the position of the pixel column in the first and second unit regions is a certain position in the cross direction, M and K are different values.

2. The printing control apparatus according to claim 1, wherein, in each of the plurality of ejection port arrays, the plurality of ejection ports are arranged in the array direction at a density of 600 ports per inch, and wherein a maximum value of a difference between values of M of two pixel columns in the first unit region adjacent to each other in the cross direction is three.

3. The printing control apparatus according to claim 1, wherein, in each of the plurality of ejection port arrays, the plurality of ejection ports are arranged in the array direction at a density of 600 ports per inch, and wherein a maximum value of a difference between values of K of two pixel columns in the second unit region adjacent to each other in the cross direction is three.

4. The printing control apparatus according to claim 1, wherein M and K periodically increase or decrease as the position of the pixel column in the first and second unit regions, respectively, changes in the cross direction.

5. The printing control apparatus according to claim 1, wherein a way in which M continuously increases and decreases and a way in which K continuously increases and decreases are different from each other.

6. The printing control apparatus according to claim 1, wherein the second unit region is the same unit region as the first unit region.

7. The printing control apparatus according to claim 1, wherein print data to be used for printing an image is generated on the basis of data regarding the image and a mask pattern including print permitting pixel data that permits printing at the pixels and print non-permitting pixel data that doesn't permit printing at the pixels.

8. The printing control apparatus according to claim 1, wherein the second printing ratio is substantially equal to the first printing ratio.

9. The printing control apparatus according to claim 1, wherein the ejection ports in the first non-overlap portion are arranged in the first ejection port array, and wherein the ejection ports in the second non-overlap portion are arranged in the second ejection port array.

10. The printing control apparatus according to claim 1, wherein the second operation of the scanning, the first operation of the scanning, and the third operation of the scanning are performed in this order as the plurality of operations of the scanning.

11. The printing control apparatus according to claim 1, wherein a boundary of a first image printed in the first unit region by the ejection of ink from M of the N ejection ports of the second ejection port array in the overlap portion at the position of each pixel column in the cross direction has a shape of continuous and periodical waves, and wherein a boundary of a second image printed in the second unit region by the ejection of ink from K of the N ejection ports in the second non-overlap portion at the position of each pixel column in the cross direction has a shape of continuous and periodical waves.

12. The printing control apparatus according to claim 11, wherein a period of the shape of waves of the boundary of the second image is different from a period of the shape of waves of the boundary of the first image.

13. The printing control apparatus according to claim 11, wherein amplitude of the shape of waves of the boundary of the second image is different from amplitude of the shape of waves of the boundary of the first image.

14. The printing control apparatus according to claim 11, wherein a phase of the shape of waves of the boundary of the second image is different from a phase of the shape of waves of the boundary of the first image.

15. The printing control apparatus according to claim 14, wherein the phase of the shape of waves of the boundary of the second image is opposite to the phase of the shape of waves of the boundary of the first image.

16. The printing control apparatus according to claim 1, wherein the plurality of ejection port arrays further include third and fourth ejection port arrays different from the first and second ejection port arrays, wherein the ejection ports in the first non-overlap portion are arranged in the third ejection port array, and wherein the ejection ports in the second non-overlap portion are arranged in the fourth ejection port array.

17. The printing control apparatus according to claim 16, wherein, in the print head, the fourth ejection port array, the first ejection port array, the second ejection port array, and the third ejection port array are arranged in the array direction in this order.

18. The printing control apparatus according to claim 17, wherein the third ejection port array is arranged at one end of the plurality of ejection port arrays in the array direction, and wherein the fourth ejection port array is arranged at another end of the plurality of ejection port arrays in the array direction.

* * * * *